US005292083A

United States Patent [19]

Ridenour

[11] Patent Number: 5,292,083

[45] Date of Patent: Mar. 8, 1994

[54] CONSTRUCTION FOR SECURING A PAPER ROLL TO A HOLDER

[75] Inventor: Ralph G. Ridenour, Mansfield, Ohio

[73] Assignee: Universal Enterprises, Inc., Mansfield, Ohio

[21] Appl. No.: 912,126

[22] Filed: Jul. 9, 1992

Related U.S. Application Data

[63] Continuation of Ser. No. 567,297, Aug. 14, 1990, abandoned.

[51] Int. Cl.[5] ..... B65H 19/10

[52] U.S. Cl. ..... 242/55.2

[58] Field of Search ..... 242/55.2, 55.3, 55.53, 242/55.54, 68.4; D6/518, 520, 522, 523

[56] References Cited

U.S. PATENT DOCUMENTS

| | | | |
|---|---|---|---|
| 925,105 | 6/1909 | Kaufman | 242/55.2 |
| 1,045,311 | 11/1912 | Moberg | 242/55.2 |
| 1,559,663 | 11/1925 | Baldwin | 242/55.2 |
| 2,049,964 | 8/1936 | Lawson | 242/55.2 |
| 2,486,607 | 11/1949 | Laystrom et al. | 242/55.2 |
| 2,492,728 | 12/1949 | Balz | 242/55.2 |
| 2,889,122 | 6/1959 | McConnell | 242/55.2 |
| 3,037,718 | 6/1962 | Pettit | 242/55.53 |
| 3,038,676 | 6/1962 | Mayer | 242/55.2 |
| 3,140,059 | 7/1964 | Lusebrink | 242/55.2 |
| 3,554,456 | 1/1971 | Moore | 242/55.2 |
| 4,239,163 | 12/1980 | Christian | 242/55.2 |

FOREIGN PATENT DOCUMENTS

| | | | |
|---|---|---|---|
| 434333 | 8/1935 | United Kingdom | 242/55.2 |

*Primary Examiner*—Daniel P. Stodola
*Assistant Examiner*—John Q. Nguyen
*Attorney, Agent, or Firm*—Pearne, Gordon, McCoy & Granger

[57] ABSTRACT

Multiple embodiments of a construction for exerting a force substantially along the longitudinal axis of a roll of paper towels supported between two side arms of a paper towel holder. The longitudinal force urges the side arms outwardly toward their maximum deflection point to increase the stability of the holder. Each end of the constructions includes a cylindrical portion that fits over each bearing member of the side arms. The longitudinal force is created by either a spring inserted within the core of a roll of paper towels, or a bellows portion of the construction. Each bellows portion is made of a thermoplastic material having sufficient elastic properties to create the longitudinal forces.

3 Claims, 2 Drawing Sheets

CONSTRUCTION FOR SECURING A PAPER ROLL TO A HOLDER

This is a continuation of application Ser. No. 07/567,297, filed Aug. 14, 1990, now abandoned.

BACKGROUND OF THE INVENTION

1. Field of the Invention

This invention relates generally to constructions for supporting objects capable of being wound off a holding device, and more particularly to support structures for preventing a roll of paper towels from being inadvertently pulled off a paper towel holder.

2. Description of the Prior Art

A common problem encountered during the unwinding of rolled articles is the inadvertent disconnection of the rolled article from its holder. For instance, a roll of paper towels, typically 11 inches in length, is commonly supported between a pair of opposing side arms that extend from a base member. The base member is often mounted underneath a kitchen cabinet or the like. Each side arm is typically provided with a cylindrical bearing member which is axially inserted within the core of the roll of paper towels. The core is typically a hollow tubular member made of cardboard about which the paper towels are rolled. The cylindrical bearing members are usually biased towards the center of the paper towels by the inherent elastic properties of the material of which the side arms and base are made. The side arms must be deflected outwardly and spread apart in order to allow the cylindrical bearing members to be inserted within the ends of a paper towel roll. Once inserted the side arms try to return to their relaxed position and thus they grasp the paper towel roll.

After mounting a roll of paper towels as described above, the paper towels can be unwound at the user's discretion. Generally speaking, the amount of axial force exerted by the side arms is sufficient to prevent the roll of paper towels from being pulled off the holder when the towels are being unwound. However, to tear off a sheet of paper a relatively strong force must be exerted to separate the perforation between two sheets. This force is usually exerted axially along the perforation and often times deflects the side arms sufficiently to dislodge the paper roll from the holder. To stabilize the paper towel holder, the user typically places one hand on the roll of paper towels while simultaneously tearing a sheet off with the other hand. This helps assure that the side arms do not deflect outwardly when the axial force is applied. However, often times the user will have two wet hands, or one hand will be unavailable for supporting the roll of paper towels. In this situation, the sudden force applied to break the perforation often leads to the roll being jerked off the holder because one side arm is deflected far enough to withdraw the bearing member from the core of the paper roll. This type of mishap often results in the waste of some paper towels, and causes frustration to the user because the paper towels must be remounted.

Another reason why paper rolls may become disconnected from their holder is that the cylindrical bearing members of some holders do not extend far enough into the core of a paper roll. If the bearing members do not penetrate deep enough axially, then even a force applied perpendicularly to the axis of the core when unwinding the paper roll may dislodge the roll from its holder. For example, if a user needs several sheets of paper towels, a sudden force will be applied to unwind the desired number of sheets. This forward force may pull the ends of the paper roll over the bearing members, causing the side arms to deflect outwardly. The outward deflection will most likely cause the paper roll to fall from the holder.

An exemplary paper towel holder is disclosed in U.S. Pat. No. 2,049,964, issued to H. D. Lawson on Aug. 4, 1936, and incorporated herein by reference. This holder includes a pair of side arms pivotally mounted upon a base. Each side arm includes a bearing member which can be axially inserted within a roll of paper towels. A flat spring plate is arranged between each side arm and the base to bias the side arms inwardly. This is the type of holder which is susceptible to the problems described above.

Many paper roll holder designs employ a spindle that is inserted within the core of the paper towels, or often times toilet tissue, which spans the distance between the members supporting the spindle. In particular, U.S. Pat. No. 3,362,653, issued to E. F. Carlisle on Jan. 9, 1968, and incorporated herein by reference, discloses a quick change roller that utilizes a two-piece telescoping spindle to support a roll of toilet tissue between two side arms. The spindle has a spring placed therein that exerts compressional forces against the side arms to support the roll. Each end of the spindle includes s stub-shaft which is receivable within a bearing of the side arms.

Two patents similar to Carlisle, U.S. Pat. Nos. 1,117,342 and 2,801,809, issued to Currie and Glaner, respectively, and incorporated herein by reference, disclose paper roll holders that employ spring-loaded spindles to support a roll between two side arms. Each end of the spindles has a trunnion for inserting within an aperture of the side arms to support the roll.

U.S. Pat. No. 4,535,947, issued to Hidle on Aug. 20, 1985, and incorporated herein by reference, discloses a paper towel insert and dispenser specifically designed to overcome the problem of paper rolls becoming disconnected from their holder as discussed above. This is accomplished by supplying a holder that includes at least one support tube insert that increases the axial penetration of the support cylinders within the core of the paper roll. Each support tube insert can be axially translated between an extended position and a retracted position. The inserts need to be retracted in order to mount a paper roll upon the support cylinders. Once the paper roll is mounted, the inserts are translated to their extended position to provide the necessary increase in axial penetration. Each support tube insert includes a locking bar that is attached to a finger grasp bar for locking the inserts in their extended position. One disadvantage of this embodiment is that it includes working parts that are subject to fatigue and may eventually need replacement. Also, these axial inserts can only be used with paper towel holders specifically designed to accommodate them. Paper towel holders such as that disclosed in Lawson above are not readily adaptable for use with this type of insert.

Thus, there still exists a need for a simple and economical construction that can be used with current paper towel holders to help assure that the paper towels will not be inadvertently jerked from the holder.

SUMMARY OF THE INVENTION

Accordingly, a preferred embodiment of the present invention provides a compression means that exerts an axial force to help secure a paper roll between two side arms of a paper roll holder. It also provides means for securing the compression means over each bearing member located on the free end of each side arm.

One embodiment of the present invention includes an elongated coil spring having closely wound convolutions on each end. The spring is inserted within the core of a paper roll. The side arms are deflected outwardly and each end of the spring is placed over one bearing member of each side arm. The inherent elastic properties of the side arms delimit the distance the side arms may be deflected outwardly. This limit is the maximum deflection point of each side arm.

The axial force exerted by the spring urges the side arms toward their maximum deflection point, thereby establishing a more stable structure. The increased stability of the holder decreases the likelihood that the side arms will be deflected when a sheet is torn from the paper roll. Also, the closely wound convolutions on each end of the spring rigidly secure the spring over the bearing members. The axial penetration of the bearing members is effectively extended by the closely wound convolutions. The closely wound convolutions are thus employed advantageously to help prevent the ends of the spring from slipping over the bearing members when a force is applied to unwind several sheets of paper.

In an alternate embodiment, a cylindrical tubular section is joined to each end of the spring. Each tubular section is fit over one bearing member so that the tubular sections rigidly secure the spring between the side arms. The tubular sections extend the axial penetration of the bearing members to help prevent the paper roll from being inadvertently pulled from the holder.

Another embodiment provides an elongated tube that can be inserted within the core of the paper roll. The tube includes a bellows section that creates the axial force. The force exerted by the bellows section acts in the same manner as the force created by the spring discussed above, i . e. , the axial force urges the side arms toward their maximum deflection point, thereby increasing the overall stability of the holder. Also, each end of the tube fits over one bearing member to rigidly secure the tube between the side arms. It is also feasible for a paper manufacturer to roll paper towels directly onto the elongated tube rather than the cardboard core.

The present invention may also be practiced by another alternate embodiment that provides at least one insert that can be inserted in one end of the core of a paper roll. The insert is also placed over one bearing member. Each insert supplies an axial force that urges the side arms outwardly toward their maximum deflection point. It is preferred that one insert be placed in each end of the paper roll, but one insert may be used in one end of the paper roll, with the opposite end of the paper roll being placed over a bearing member of one side arm.

One embodiment of the insert includes a bellows portion, a cylindrical portion, and a frustoconical seat portion. The seat is partially inserted within the core of the paper roll and the cylindrical portion is fit over one bearing member. The bellows portion creates the axial force that helps stabilize the paper roll holder.

An alternate embodiment of the insert includes an extension portion, a flange portion, a bellows portion, and a cylindrical portion. The extension portion is inserted within one end of the paper roll core so that the flange portion abuts the corresponding end of the paper roll to prevent the insert from going inside the core. The cylindrical portion is fit over one bearing member, and the bellows portion creates the axial force necessary to stabilize the holder. Again, one insert may be used in one end of the core, with the other end of the core being placed over a bearing member of one side arm, but it is preferred that two inserts be used, one in each end of the core.

One primary advantage of the present invention is that each of the foregoing embodiments is simplistic in its construction and economical to manufacture. Another advantage is that all embodiments of the present invention can be used with many paper roll holders that have already been purchased by the consuming public. The embodiments are easy to use and are made of a thermoplastic material or steel, which gives them a durable and extended useful life.

DETAILED DESCRIPTION OF THE PREFERRED EMBODIMENT

Figure 1:
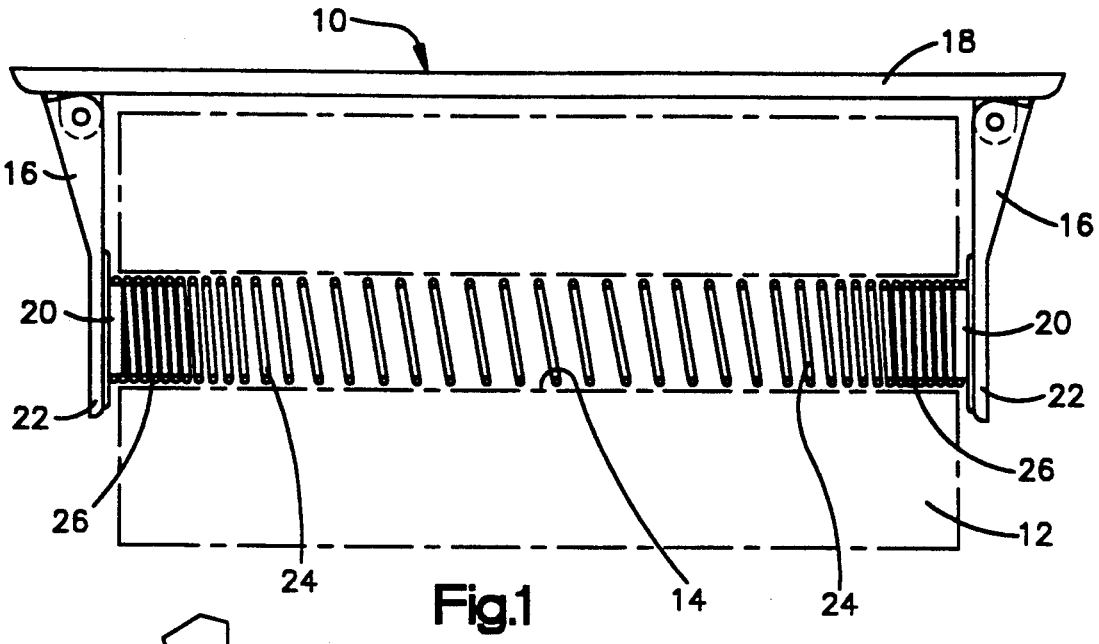
FIG. 1 is a front plan view of a paper towel holder with a cross-sectional view of a paper towel roll mounted upon a preferred embodiment of the present invention.

Referring now to the drawings, and in particular to FIG. 1, there is shown a paper towel holder 10 supporting a roll of paper towels 12 that are rolled upon a cardboard core 14. A pair of biased side arms 16 extend from the base 18 of the paper towel holder 10. Each side arm 16 includes a knob-like bearing member 20 near its free end 22.

Figure 2:
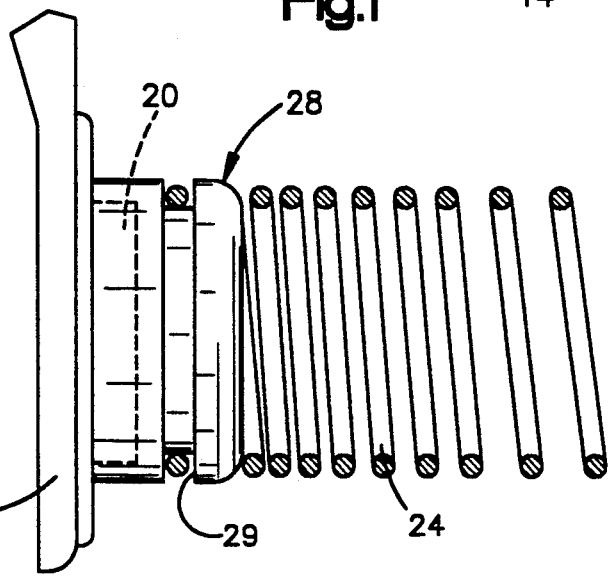
FIG. 2 is a front plan view of a second embodiment of the end portion of the invention of FIG. 1 shown to a larger scale.

In the typical manner, one end of the core 14 is fit over one bearing member 20 and the other end of the core 14 is fit over the other bearing member 20 so that the roll of paper towels 12 is supported between the side arms 16. FIG. 1 also shows a preferred embodiment of the present invention comprising a spring 24 that is inserted within the core 14. The spring 24 acts as a compression means that supplies a force substantially along the longitudinal axis of the core 14. The side arms 16 are forced by the spring 24 to move from a first position, which is generally perpendicular to the base 18, to a second position which is outwardly spaced from the first position. As stated previously, the side arms are resilient and deformable, the inherent elastic properties of the side arms delimiting the distance the side arms may be deflected outwardly and thereby defining the maximum deflection point. The axial force exerted by the spring 24 urges the side arms 16 towards their maximum outward deflection point, decreasing the likelihood that the side arms will be further deflected when a sheet is torn from the paper roll. Preferably, a coil spring portion 26 is joined to each end of the spring 24. Each coil spring portion 26 is made of about seven closely wound convolutions and fits over one bearing member 20. In an alternative embodiment as shown in FIG. 2, a tubular section 28 is joined to each end of the spring 24 by means of an annular recess 29 located on one end of the tubular section 28. Each tubular section 28 is preferably made of thermoplastic material, but could alternatively be made of any suitable material. The inside diameters of the coil spring portions 26 and the tubular sections 28 are slightly larger than the outside diameter of the bearing members 20 so that the coil spring portions 26 and the tubular sections 28 fit tightly over the bearing members 20.

The overall length of the spring 24 and the coil spring portions 26 or the tubular sections 28 is preferably between about 12.5 inches and 13 inches when the spring 24 is at rest. The spring 24 is preferably made of steel, but could alternatively be made of any suitable material.

Figure 3:
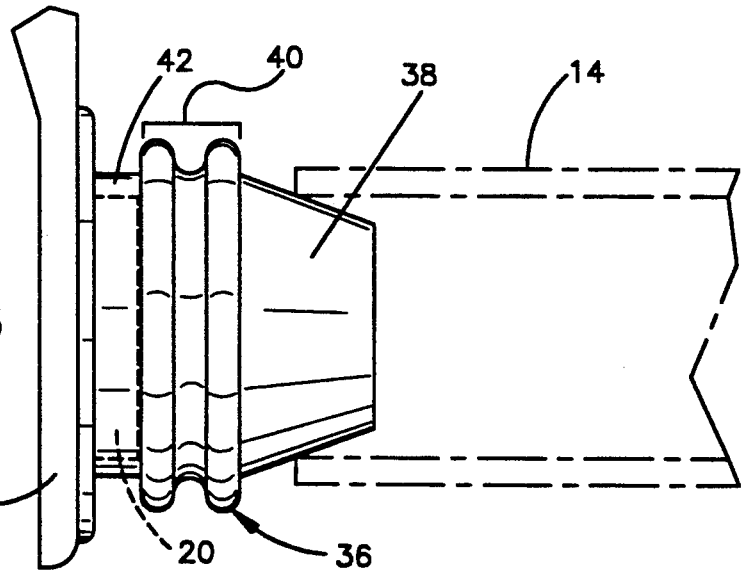
FIG. 3 is a front plan view of a portion of the paper towel holder of FIG. 1 having a third embodiment of the present invention mounted thereon and having the core of the paper towel roll, shown in cross section, placed thereover.

Another embodiment of the present invention includes at least one insert 36 as shown in FIG. 3. Each insert 36 preferably includes a frustoconical seat portion 38 that is partially insertable within one end of the core 14. Alternatively, for example, the seat portion 38 could be made of circumferentially spaced tabs having their free ends angled inwardly toward each other. Each insert 36 also includes a bellows portion 40 and a cylindrical portion 42. The frustoconical seat portion 38 and the bellows portion 40 act as the compression means. Each cylindrical portion 42 preferably has an inside diameter that is slightly larger than the outside diameter of the bearing members 20 so that the cylindrical portions 42 fit tightly over the bearing members 20. Preferably, the inserts 36 are made of a thermoplastic material having appropriate elastic properties so that the compression means creates a force substantially along the longitudinal axis of the core 14. The inserts 36 could alternatively be made of any appropriate material which provides the requisite axial force to urge the side arms outwardly toward their maximum deflection point. One insert 36 could be used alone in one end of the core 14 with the other end of the core 14 supported over one bearing member 20, but preferably two inserts 36 are used, one in each end of the core 14.

Figure 4:
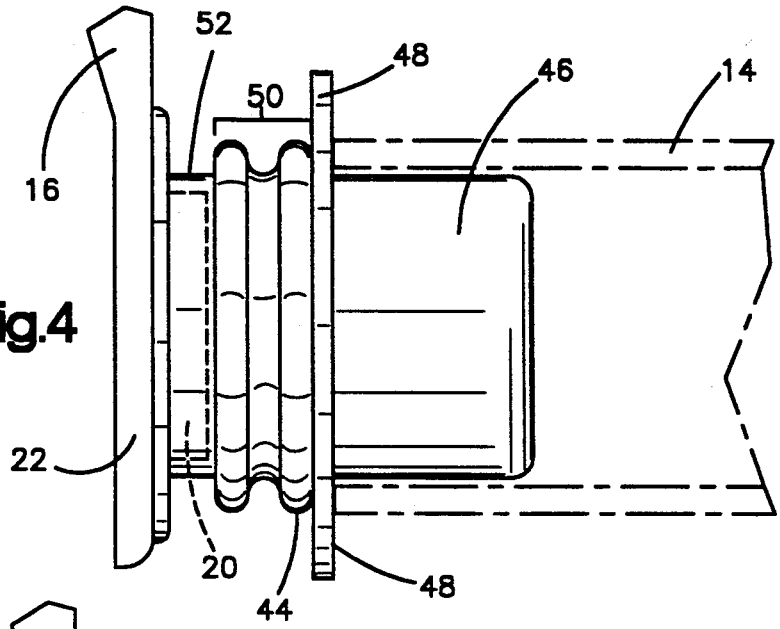
FIG. 4 is a front plan view of the paper towel holder of FIG. 3 having a fourth embodiment of the present invention mounted thereon.

Still another embodiment, shown in FIG. 4, includes at least one insert 44. Each insert 44 includes an extension portion 46, a flange portion 48, and a bellows portion 50 that comprise the compression means. Each extension portion 46 fits within one end of the core 14. Each extension portion 46 is preferably cylindrical, but could alternatively be of other suitable configurations, such as circumferentially spaced tabs, for example. The flange portion 48 is joined to each insert 44 so that each flange portion 48 is substantially perpendicular to the extension portion 46. The flange portion 48 of one insert 44 abuts the outer surface of one end of the paper towel roll 12 when that insert 44 is placed within the core 14, as shown in FIG. 4.

Each insert 44 is preferably made of a thermoplastic material having appropriate elastic properties so that the compression means of each insert 44 creates a force substantially along the longitudinal axis of the core 14. The inserts 44 could alternatively be made of any appropriate material supplying the requisite axial force to urge the side arms outwardly toward their maximum deflection point. Each insert 44 also includes a cylindrical portion 52 that fits over one bearing member 20. The inside diameter of each cylindrical portion 52 is preferably slightly larger than the outside diameter of each bearing member 20 so that the inserts 44 fit tightly over the bearing members 20.

Figure 5:
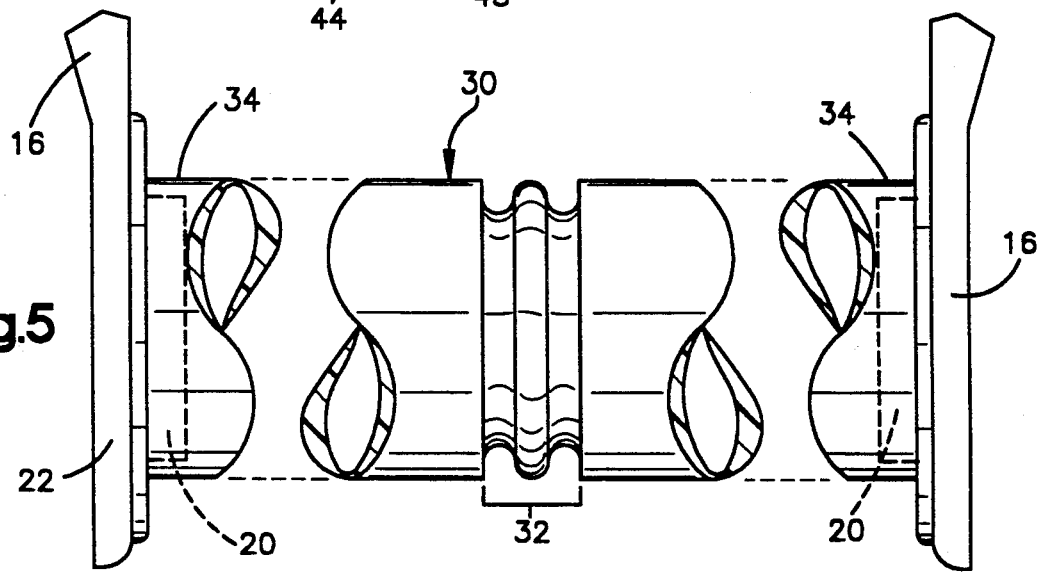
FIG. 5 is a front plan view of another embodiment of the present invention of FIG. 1 shown to a larger scale.

FIG. 5 shows another embodiment of the present invention which comprises an elongated tube 30 having a bellows portion 32 near its center. Alternatively, the bellows portion 32 could be located off-center, or there could be more than one bellows portion if desired. The elongated tube 30 and bellows portion 32 act as the compression means that supplies a force substantially along the longitudinal axis of the roll of paper towels 12. The elongated tube 30 is preferably between about 12.5 inches and 13 inches in length when at rest. It is made of a suitable thermoplastic material having elastic properties which create the longitudinal force. Each cylindrical end portion 34 of the elongated tube 30 is fit over one of the bearing members 20 so that the roll of paper towels 12 is supported between the side arms 16. Alternatively, the end portions 34 could be other shapes, such as squares or triangles, for example. The inside diameter of the cylindrical end portions 34 is preferably slightly larger than the outside diameter of the bearing members 20 so that the cylindrical portions 34 fit tightly over the bearing members 20. The elongated tube 30 can be inserted within the core 14, or the paper towels can be rolled directly onto the elongated tube 30.

Figure 6:
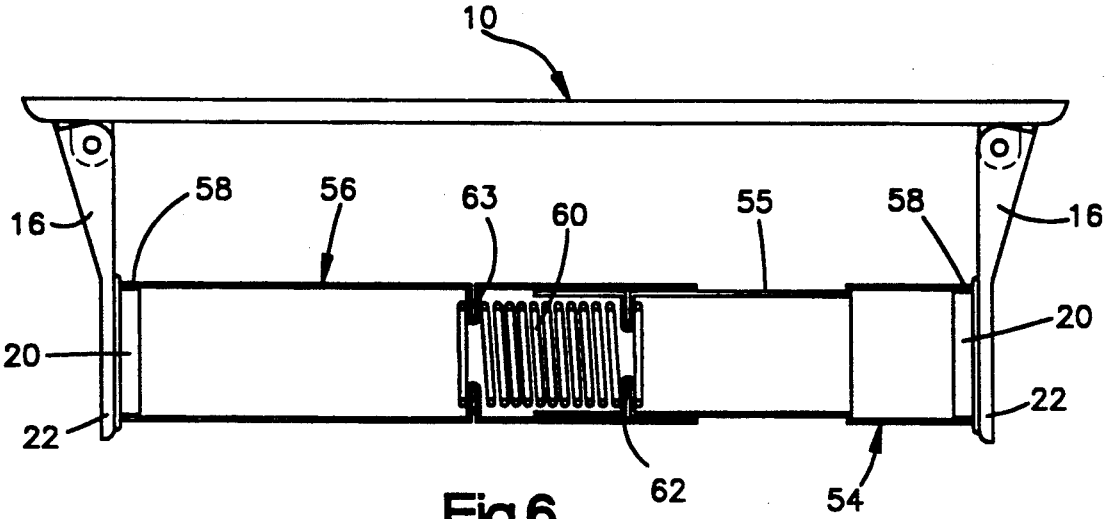
FIG. 6 is a front plan view of still another embodiment of the present invention of FIG. 1.

Referring now to FIG. 6, another embodiment of the present invention includes a first telescoping portion 54, a second telescoping portion 56, and a spring 60, which comprise the compression means. Each telescoping portion 54 and 56 has a cylindrical portion 58 joined to it at one end. Preferably, each cylindrical portion 58 has an inside diameter that is slightly larger than the outside diameter of the bearing members 20 so that the cylindrical portions 58 fit tightly over the bearing members 20 one end of the spring 60 is joined to an annular recess 62 located near one end of the telescoping portion 54. The other end of the spring 60 is joined to an annular recess 63 located in the telescoping portion 56. A reduced diameter section 55 of the telescoping portion 54 is inserted within the telescoping portion 56. The overall length of the joined telescoping portions 54 and 56 is preferably between about 12.5 inches and 13 inches when the spring 60 is at rest.

While the preferred embodiments of the present invention are shown and described herein, it is to be understood that the same is not so limited but shall cover and include any and all modifications thereof which fall within the purview of the invention. For example, the knob-like bearing member is disclosed in the drawing figures as being generally cylindrical in shape. Naturally, it is within the scope of the invention for the bearing member to be any shape, i.e. triangular, square, etc., so long as it performs in the manner described and claimed.

What is claimed is:

1. A support structure for helping to prevent a roll of paper which is rolled upon a core from being inadvertently pulled off a paper roll holder that includes a base, a pair of biased side arms extending from the base, at least one of said arms being deformable from a first position to a second position, said second position being outwardly spaced relative to said first position, a knob-like bearing member disposed on the free end of each side arm, the bearing members facing each other so that one end of the roll of paper can be placed over one bearing member and the opposite end of the roll can be placed over the other bearing member whereby the roll of paper is supported between the side arms, said support structure comprising:

spring means insertable within at least a portion of the core of the paper roll for exerting a force generally along the longitudinal axis of the roll of paper to urge said at least one of the side arms outwardly from said first position to said second position, said spring means including a coil spring inserted within the core of the paper roll; and means for securing said spring means over at least one of the bearing members, wherein said means for securing said spring means comprises an end of said coil spring, said end of said coil spring directly engaging one of said bearing members and releasably retaining said spring means on said bearing member.

2. A support structure as recited in claim 1, wherein:

said means for securing said spring means over at least one of the bearing members comprises a pair of coil spring portions each having closely wound convolutions, one of said coil spring portions being joined to one end of said coil spring and the other of said coil spring portions being joined to the opposite end of said coil spring, each of said coil spring portions having an inside diameter slightly larger than the outside diameter of each bearing member so that said coil spring portions fit tightly over the bearing members.

3. A support structure as recited in claim 1, wherein:

said spring means comprises a spring spanning the core of the paper roll, said support structure having an overall length of between about 12.5 and 13 inches; and said means for securing said spring means over at least one of the bearing members comprises a pair of coil spring portions each having closely wound convolutions, one of said coil spring portions being joined to one end of said coil spring and the other of said coil spring portions being joined to the opposite end of said coil spring, each of said coil spring portions having an inside diameter slightly larger than the outside diameter of each bearing member so that said coil spring portions fit tightly over the bearing members.

* * * * *